US009366158B1

(12) United States Patent
Dougherty

(10) Patent No.: US 9,366,158 B1
(45) Date of Patent: Jun. 14, 2016

(54) UNITARY CAM FOLLOWER AND VALVE PRELOAD SPRING FOR A DESMODROMIC VALVE MECHANISM

(71) Applicant: James T. Dougherty, Indianapolis, IN (US)

(72) Inventor: James T. Dougherty, Indianapolis, IN (US)

( * ) Notice: Subject to any disclaimer, the term of this patent is extended or adjusted under 35 U.S.C. 154(b) by 0 days.

(21) Appl. No.: 14/178,881

(22) Filed: Feb. 12, 2014

Related U.S. Application Data

(63) Continuation-in-part of application No. 14/149,285, filed on Jan. 7, 2014, which is a continuation of application No. 12/976,534, filed on Dec. 22, 2010, now Pat. No. 8,622,039.

(51) Int. Cl.
*F01L 1/30* (2006.01)

(52) U.S. Cl.
CPC ..... *F01L 1/30* (2013.01)

(58) Field of Classification Search
CPC ..... F01L 1/30
USPC ..... 123/90.24
See application file for complete search history.

(56) References Cited

U.S. PATENT DOCUMENTS

| | | | |
|---|---|---|---|
| 977,847 | A | 12/1910 | Wright |
| 1,185,925 | A | 6/1916 | Newcomb |
| 1,340,717 | A | 5/1920 | Holle |
| 1,644,059 | A | 10/1927 | Holle |
| 1,751,646 | A | 3/1930 | Nieman |
| 1,937,152 | A | 11/1933 | Jünk |
| 3,183,901 | A | 5/1965 | Thuesen |
| 3,195,878 | A | 7/1965 | Rosky et al. |
| 3,430,614 | A | 3/1969 | Meacham |
| 3,862,751 | A | 1/1975 | Schwaller |
| 4,327,677 | A | 5/1982 | Vander Bok |

(Continued)

FOREIGN PATENT DOCUMENTS

| | | |
|---|---|---|
| EP | 1624161 A1 | 2/2006 |
| FR | 580537 | 11/1924 |

(Continued)

OTHER PUBLICATIONS

Extended European Search Report dated Mar. 19, 2014, EP Application No. 11850197.2, 3 pgs.

(Continued)

*Primary Examiner* — Zelalem Eshete
(74) *Attorney, Agent, or Firm* — William F. Bahret

(57) ABSTRACT

A unitary cam follower and valve preload spring for a desmodromic valve mechanism having opening and closing cams mounted in parallel on an overhead camshaft so as to facilitate positive bidirectional drive of a valve. The device comprises a generally tubular spring member of oblong transverse cross-section, a shaped extension spring, preferably a band or basket. The spring member is configured to be non-rotatably mounted on the camshaft with its longitudinal axis parallel to the camshaft axis and its major axis aligned with the valve stem axis, substantially surrounding the opening and closing cams circumferentially and engaging the valve stem and closing cam so as to pull the valve stem in response to an upward force applied to the upper portion of the spring member by the closing cam. The spring member is further configured to elongate along its major axis in response to tension applied thereto during assembly so as to preload the valve stem, and it has an effective spring rate which varies depending on conditions.

22 Claims, 3 Drawing Sheets

(56) References Cited

U.S. PATENT DOCUMENTS

| | | | | |
|---|---|---|---|---|
| 4,471,729 | A * | 9/1984 | Eickmann | 123/90.26 |
| 4,711,202 | A | 12/1987 | Baker | |
| 4,763,615 | A | 8/1988 | Frost | |
| 4,858,573 | A | 8/1989 | Bothwell | |
| 4,887,565 | A | 12/1989 | Bothwell | |
| 4,922,867 | A | 5/1990 | Mathews | |
| 5,048,474 | A | 9/1991 | Matayoshi et al. | |
| 5,058,540 | A | 10/1991 | Matsumoto | |
| 5,390,496 | A | 2/1995 | El Affaqui | |
| 6,053,134 | A | 4/2000 | Linebarger | |
| 6,276,324 | B1 | 8/2001 | Adams et al. | |
| 6,487,997 | B2 | 12/2002 | Palumbo | |
| 6,705,262 | B2 | 3/2004 | Battlogg | |
| 6,802,287 | B2 | 10/2004 | Battlogg | |
| 6,948,468 | B1 | 9/2005 | Decuir | |
| 6,951,148 | B2 | 10/2005 | Battlogg | |
| 6,968,814 | B2 | 11/2005 | Battlogg | |
| 7,051,691 | B2 | 5/2006 | Battlogg | |
| 7,421,988 | B2 | 9/2008 | Battlogg | |
| 8,622,039 | B2 | 1/2014 | Dougherty | |
| 2001/0032959 | A1 | 10/2001 | Parker et al. | |
| 2004/0177821 | A1 * | 9/2004 | Battlogg | 123/90.24 |
| 2005/0188936 | A1 | 9/2005 | Illien | |
| 2012/0160199 | A1 | 6/2012 | Dougherty | |

FOREIGN PATENT DOCUMENTS

| | | | |
|---|---|---|---|
| GB | 558779 | | 1/1944 |
| GB | 2166799 | A | 5/1986 |
| WO | WO 87/03645 | | 6/1987 |
| WO | WO 2008/030589 | A2 | 3/2008 |
| WO | WO 2009/070156 | A1 | 6/2009 |

OTHER PUBLICATIONS

European Search Opinion dated Mar. 19, 2014, Application No. 11850197.2, 4 pgs.

"Classification," [online], undated, [retrieved Mar. 5, 2010]. Retrieved from the Internet: http://members.chello.nl/~wgj.jansen/text/classification.html (2 pages).

"One Hundred Years of Desmo-Patenting: A Factual Summary," [online], © 2001 [retrieved Dec. 22, 2010]. Retrieved from the Internet: http://members.chello.nl/~wgj.jansen/text/honderdjaar.html (8 pages).

"Produced Desmo-Systems," [online], undated, [retrieved Dec. 22, 2010]. Retrieved from the Internet: http://members.chello.nl/~wgj.jansen/desmosys.html#True%20desmodromic%20systems (3 pages).

"Desmodromic valve," [online], c.2010, [retrieved Dec. 22, 2010]. Retrieved from the Internet: http://en.wikipedia.org/wiki/Desmodromic_valve (5 pages).

International Search Report and Written Opinion dated May 1, 2012, Application No. PCT/US2011/066441 (11 pages).

(Sub)Classification of Desmodromic Valve Gear (IPC F01L1/30), [online], undated, [retrieved Jul. 19, 2012]. Retrieved from the Internet: http://members.chello.nl/~wgj.jansen/text/englishclass.html 7/ (5 pages).

Summit Racing Equipment High Performance Automotive Parts Catalog, May-Jun. 2013 (pp. 164-166).

"Mercedes-Benz 300SLR Coupe," [online], date unknown, [retrieved Feb. 24, 2014]. Retrieved from the Internet: http://antholonet.com/EngineersCars/300SLR/300SLR.html (5 pages).

"Desmodromic History," [online], undated, [retrieved Feb. 24, 2014]. Retrieved from the Internet: http://www.italian.sakura.ne.jp/bad_toys/engine/engine05.html (35 pages).

Ruville Technical Brochure, Valve Train Components, undated, Egon Von Ruville GmbH (23 pages).

Ievins, Erik, "Valve Adjustments 101," The Early Valiant Barracuda Club, [online ] © 2002, [retrieved Jan. 15, 2014]. Retrieved from the Internet: http://www.earlycuda.org/tech/valves.htm (4 pages).

Davis, Marian, "What You Need to Know About Valvesprings—All About Valvesprings— How to Do It," Hot Rod Magazine, [online], Nov. 1, 2010, [retrieved Feb. 24, 2014]. Retrieved from the Internet: http://www.hotrod.com/techarticles/engine/hrdp_1011_what_you_need_to_know_about_valvesprings/viewall.html (11 pages).

Davis, Marian, "Generic Valvespring Selection Guidelines," in "What You Need to Know About Valvesprings—All About Valvesprings—How to Do It," Hot Rod Magazine, [online], Nov. 1, 2010, [retrieved Feb. 24, 2014]. Retrieved from the Internet: http://www.hotrod.com/techarticles/engine/ hrdp_1011_what_you_need_to_know_about_valvesprings/viewall.html (1 page).

International Search Report and Written Opinion dated May 15, 2015, Application No. PCT/US2015/015623, 9 pgs.

* cited by examiner

UNITARY CAM FOLLOWER AND VALVE PRELOAD SPRING FOR A DESMODROMIC VALVE MECHANISM

CROSS-REFERENCE TO RELATED APPLICATIONS

This application is a continuation-in-part of patent application Ser. No. 14/149,285, filed Jan. 7, 2014, which is a continuation of patent application Ser. No. 12/976,534, filed Dec. 22, 2010, now U.S. Pat. No. 8,622,039, issued Jan. 7, 2014, which applications and patent are hereby incorporated by reference along with all references cited therein.

BACKGROUND OF THE INVENTION

This invention relates to desmodromic valve systems, and more particularly to desmodromic valve systems which provide direct bidirectional displacement of a valve stem without the aid of a rocker arm.

A desmodromic valve system positively opens and closes a valve in an internal combustion engine. This is in contrast to the conventional system in which the valve is positively opened with a cam but closed with a return spring.

The main benefit of a desmodromic system is the prevention of valve float. In traditional spring valve actuation, as engine speed increases, the inertia of the valve tends to overcome the spring's ability to close the valve completely before the piston reaches TDC (Top Dead Center). In severe cases, the piston contacts the open valve and causes damage to both engine parts. More generally, if a valve does not completely return to its seat before combustion begins, it can allow combustion gases to escape prematurely, leading to a reduction in cylinder pressure which causes a major decrease in engine performance. This can also overheat the valve, possibly warping it and leading to catastrophic failure. The traditional remedy for valve float is to use a stiffer return spring. This increases the seat pressure of the valve, i.e., the static pressure that holds the valve closed, and reduces valve float at higher engine speeds. However, the engine has to work harder to open the valve. The higher forces between spring and cam cause higher stress on the parts resulting in higher temperature and faster wear or failure in the valve drive system. A desmodromic system can avoid the problem to some extent because, although it has to work against the inertia of the valve opening and closing, it does not have to overcome the energy of the spring.

Despite their advantages, desmodromic valve drive systems have had limited success in commercial application for various reasons such as design complexity, poor reliability, and valve train binding. Numerous approaches to the various problems have been taken since the earliest days of engine development, more than a hundred years ago, as evidenced by the following patents:

| Patent No. | Inventor(s) | Issue Date |
|---|---|---|
| 1,644,059 | Holle | Oct. 24, 1927 |
| 1,937,152 | Jünk | Nov. 28, 1933 |
| 3,183,901 | Thuesen | May 18, 1965 |
| 3,430,614 | Meacham | Mar. 4, 1969 |
| 4,711,202 | Baker | Dec. 8, 1987 |
| 4,763,615 | Frost | Aug. 16, 1988 |
| 4,887,565 | Bothwell | Dec. 19, 1989 |
| 5.048,474 | Matayoshi et al. | Sep. 17, 1991 |
| 5,058,540 | Matsumoto | Oct. 22, 1991 |
| 6,276,324 | Adams et al. | Aug. 21, 2001 |

-continued

| Patent No. | Inventor(s) | Issue Date |
|---|---|---|
| 6,487,997 | Palumbo | Dec, 3, 2002 |
| 6,948,468 | Decuir | Sep. 27, 2005 |
| 6,951,148 | Battlogg | Oct. 4, 2005 |

However, presently, all known desmodromic valve designs have drawbacks which make them undesirable for use in several significant applications, such as production automobiles, and there is no obvious path to a better solution.

SUMMARY OF THE INVENTION

The present invention provides a unitary cam follower and valve preload spring for a desmodromic valve mechanism having opening and closing cams mounted in parallel on an overhead camshaft so as to facilitate positive bidirectional drive of a valve. The device comprises a generally tubular spring member of oblong transverse cross-section which is configured to be nonrotatably mounted on the camshaft with its longitudinal axis parallel to the camshaft axis and its major axis aligned with the valve stem axis, substantially surrounding the opening and closing cams circumferentially and engaging the valve stem and closing cam so as to pull the valve stem in response to an upward force applied to the upper portion of the spring member by the closing cam. The spring member is further configured to elongate along its major axis in response to tension applied thereto while engaging it with the valve stem and closing cam during assembly so as to preload the valve stem.

According to another aspect of the invention, a unitary cam follower and valve preload spring for a desmodromic valve mechanism comprises a generally tubular spring member of oblong transverse cross-section which is configured to be nonrotatably mounted on a camshaft with its major axis aligned with the valve stem axis, substantially surrounding the opening and closing cams circumferentially, the generally tubular spring member having a minor axis inner diameter approximately equal to the maximum diameter of the closing cam, and a major axis inner diameter at least approximately 25% greater than its minor axis inner diameter.

According to another aspect of the invention, a cam follower and valve preload spring for a desmodromic valve mechanism comprises an oblong band configured to extend circumferentially around the closing cam and engage it and the valve stem so as to reciprocate and cyclically lift the valve stem in response to rotation of the closing cam, with the major axis of the oblong band approximately aligned with the valve stem axis, the oblong band configured to elongate along its major axis in response to tension applied thereto while engaging it with the valve stem and closing cam during assembly so as to preload the valve stem.

The objects and advantages of the present invention will be more apparent upon reading the following detailed description in conjunction with the accompanying drawings.

Figure 1:
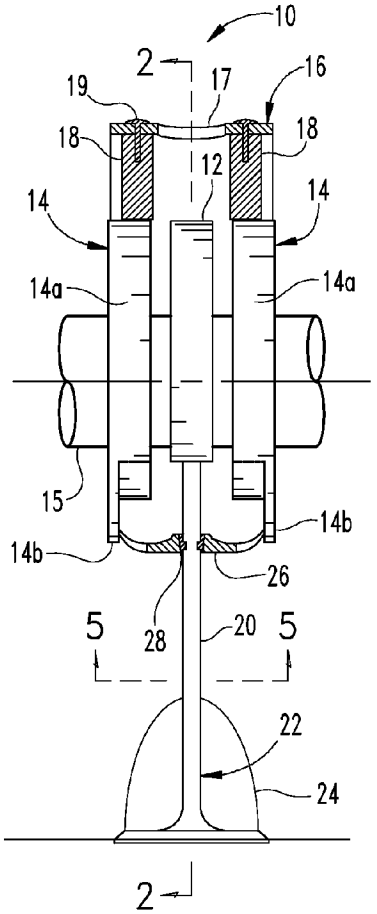
FIGS. 1-5 depict a first embodiment of a rockerless desmodromic valve system according to the present invention. This embodiment includes a semirigid band or "basket" that substantially surrounds a set of cams on a camshaft and engages paired side cams and an associated valve stem so as to pull the valve stem after it is pushed by a central cam. The basket and cams, which are drawn to scale for a nominal ½ inch valve lift, cooperate to provide reciprocating valve action with positive bidirectional drive.

FIG. 1 is a side view of the assembly with the valve closed, and with the basket and two side cam followers shown in longitudinal cross-section.

Figure 2:
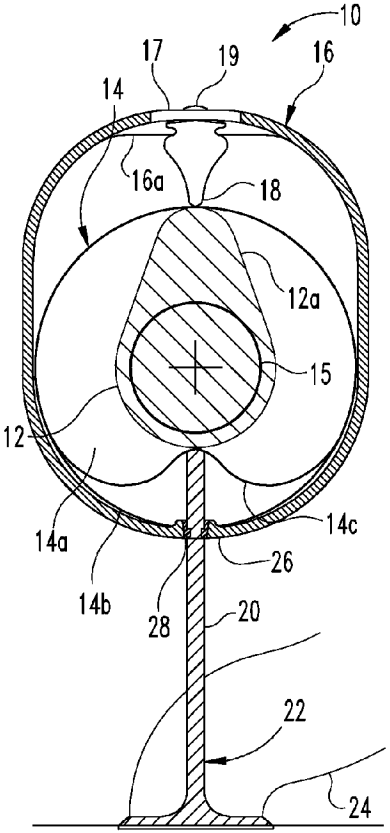

FIG. 2 is a transverse cross-section along line 2-2 of FIG. 1.

Figure 3:
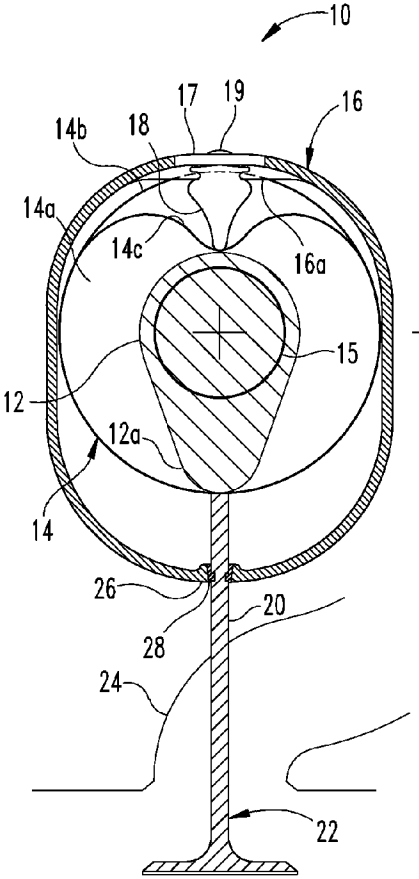
Figure 4:
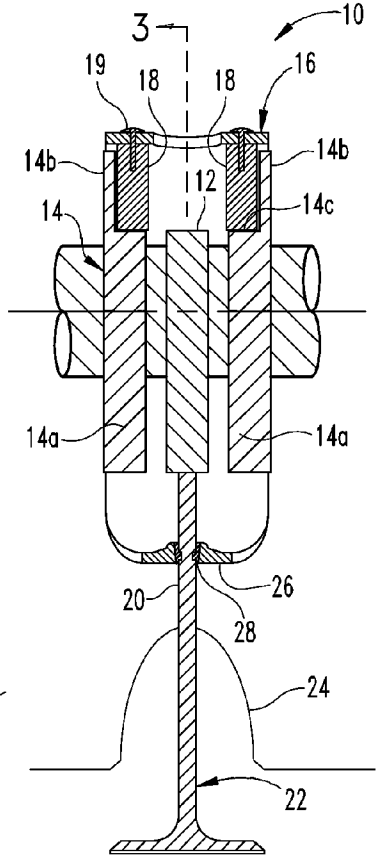

FIG. 3 is a transverse cross-section along line 3-3 of FIG. 4.

Figure 3A:
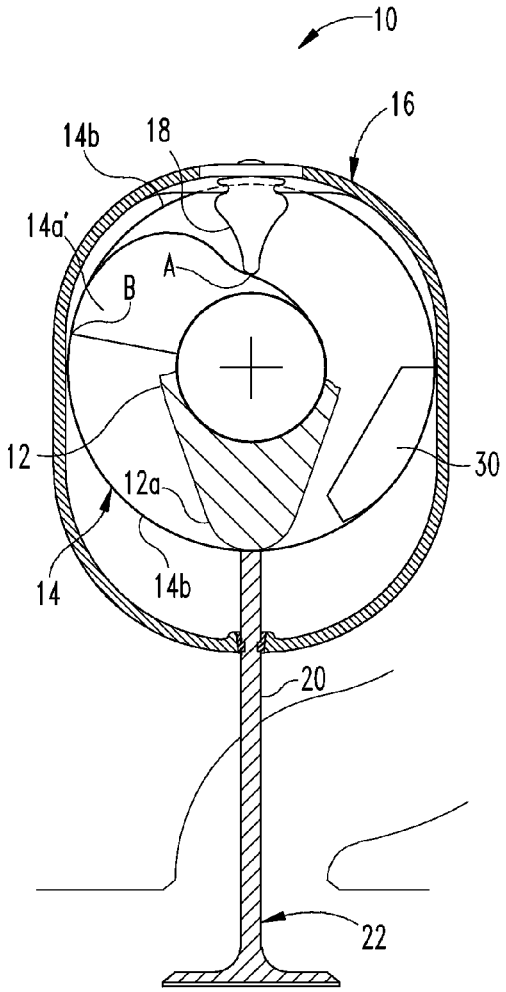

FIG. 3A is a transverse cross-section like that of FIG. 3 but with the central cam partially cut away to show the shape of an alternative side cam.

FIG. 4 is a longitudinal cross-section of the assembly with the valve open.

Figure 5:
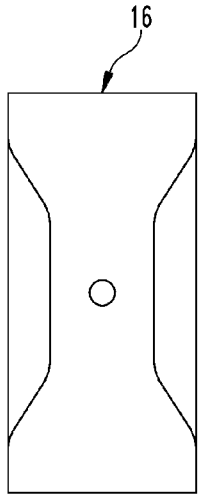

FIG. 5 is a bottom view of the basket alone, taken along line 5-5 of FIG. 1.

Figure 6:
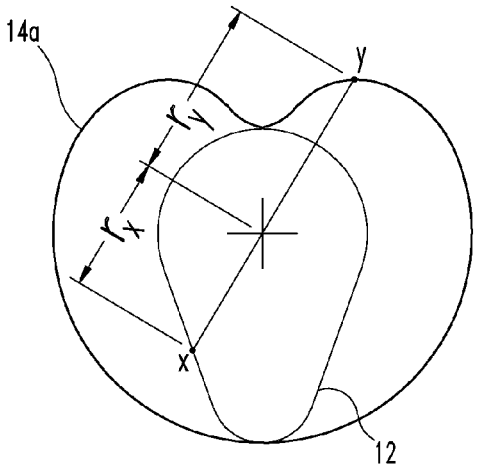

FIG. 6 shows reference points on the central cam and one side cam pertaining to the relationship between the cam radii in a preferred embodiment of the present invention.

FIGS. 7-10 depict a second embodiment of a rockerless desmodromic valve system according to the present invention. Like the first embodiment, this embodiment includes a semirigid band or "basket" and a set of cams including a central cam and a pair of side cams. The basket and cams in this case are drawn to scale for a nominal ¼ inch valve lift.

Figure 7:
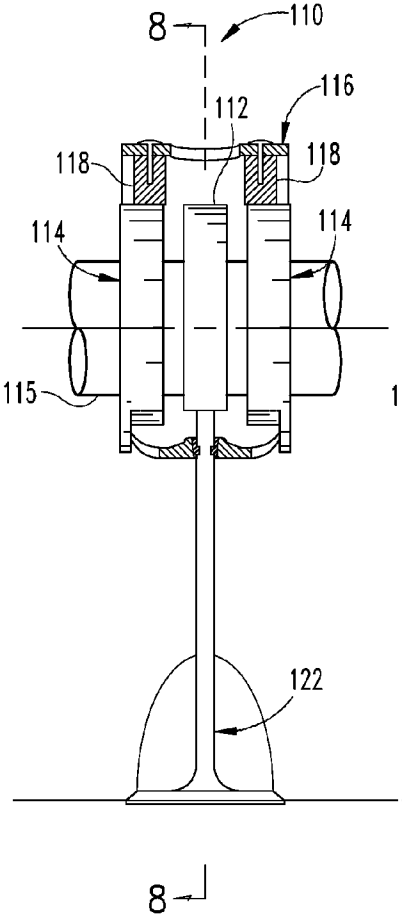

FIG. 7 is a side view of the assembly with the valve closed, and with the basket and two side cam followers shown in longitudinal cross-section.

Figure 8:
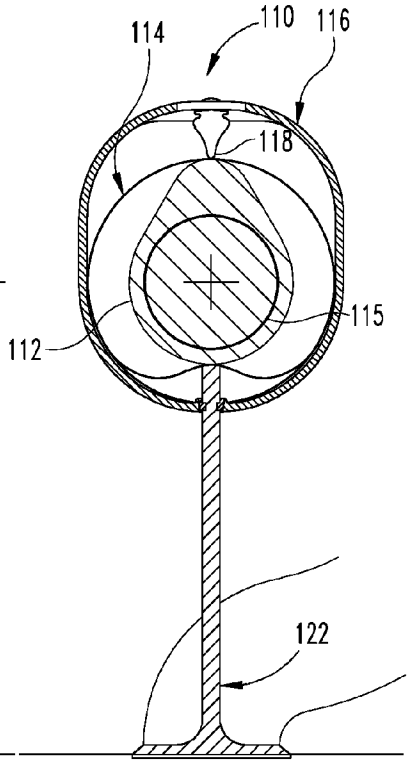

FIG. 8 is a transverse cross-section along line 8-8 of FIG. 7.

Figure 10:
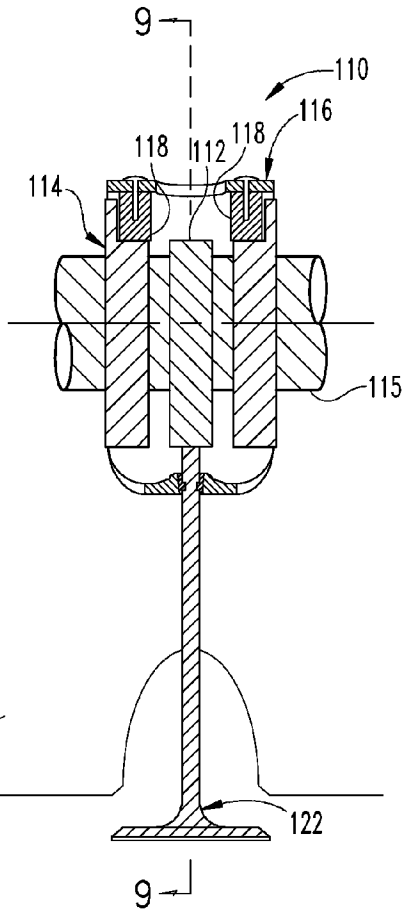
Figure 9:
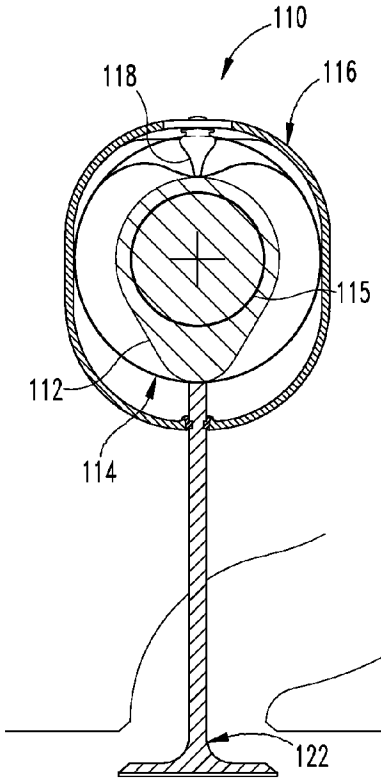

FIG. 9 is a transverse cross-section along line 9-9 of FIG. 10.

FIG. 10 is a longitudinal cross-section of the assembly with the valve open.

DESCRIPTION OF PREFERRED EMBODIMENTS

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

FIGS. 1-5, wherein like numerals represent like parts throughout the several views, depict a first embodiment 10 of a rockerless desmodromic valve system according to the present invention. In this embodiment, which is to be understood as one example of a desmodromic valve system according to the present invention, a central cam 12 and a parallel pair of side cams 14 are fixedly mounted on a camshaft 15 so as to rotate therewith, and are substantially surrounded by a semirigid band or "basket" 16 which does not rotate with the camshaft and is constrained by the cams and by its attachment to the stem 20 of a valve 22. As will be described, the band, or basket, in this embodiment is a form of shaped extension spring, with a spring rate, also referred to herein as its effective spring rate, which varies depending on conditions. Except as described herein, the camshaft and valve may be conventional parts mounted in a conventional manner in the cylinder head of an internal combustion engine in which each valve has an associated port 24 and has a valve guide (not shown) which closely surrounds the valve stem. As those skilled in the art will appreciate, there is a clearance, or valve lash, between the valve stem and its associated cam when the valve is closed. As will also be appreciated, the cylinder head conventionally has open space on opposite sides of the camshaft adjacent each cam, as well as above each cam.

Basket 16 engages paired side cams 14 and the associated valve stem 20 so as to pull the valve stem after it is pushed by central cam 12. The basket and cams cooperate to provide reciprocating valve action with positive bidirectional drive. That is, the system positively drives the valve from its closed position, illustrated in FIGS. 1 and 2, to its open position, illustrated in FIGS. 3 and 4, by conventional cam action by means of cam 12 in contact with the valve stem, and positively drives the valve back to its closed position using the basket, which is secured to the valve stem and raised by paired cams 14 acting through associated cam followers 18. Thus, cam 12 is understood to be an opening cam and each main portion 14*a* of cam 14, described below, is a closing cam.

Each cam 14 has a main portion 14*a* with a concavo-convex cross-section, and a peripheral portion or shoulder 14*b* with a circular cross-section. The concavo-convex cross-section of the main portion of cam 14 is readily apparent in FIGS. 2 and 3. In FIGS. 1 and 2, the concave part 14*c* of main portion 14*a* of cam 14 is below the camshaft axis (and axially separated from the valve stem), and the convex portion engages the associated cam follower 18 and thereby holds the basket in its raised position. Cams 12 and 14 operate in coordinated fashion such that, at this point in the cycle, lobe 12*a* of cam 12 is oriented away from the valve stem and thereby allows the valve to be lifted and thus closed by the basket. Conversely, in FIGS. 3 and 4, part 14*c* of cam 14 is above the camshaft axis and lobe 12*a* of cam 12 is oriented toward the valve stem, whereby cam follower 18—and thus basket 16—is in its lowest position and the valve is open. A cam follower, such as a snug-fitting cup or cap (not shown), is preferably also provided on the upper end of the valve stem for contact with cam 12. Such a cam follower conventionally and preferably provides lash adjustment. For example, this cam follower may be a bucket tappet adjusted in a conventional manner to leave a specified clearance between the valve stem/tappet and cam 12. A roller follower is one alternative. A hydraulic tappet, or hydraulic lifter, is another alternative but is less preferred because of performance limitations at high engine speeds and because of cost.

As one example of a set of suitable dimensions for valve system 10, cam 12 may have a maximum radius of 1 inch (at the outermost point on lobe 12*a*, or tip of the lobe) and a minimum radius (the cam's base circle radius) of ½ inch, thereby producing a valve lift—the valve displacement between open and closed positions—of ½ inch. Cam portion 14*a* has the same maximum and minimum radii as cam 12, and its radius at any given point is a function of the radius of cam 12 at a diametrically opposed point. Specifically, cam 12 and cam portion 14*a* are designed such that, at any two diametrically opposed points X and Y on their respective surfaces (see FIG. 6), $$r_x+r_y=c$$

The opening and closing cams are thus complementary. With the above example dimensions, the sum of the radius of cam 12 and the radius of cam portion 14*a* at such points X and Y is 1.5". For example, the outermost point on lobe 12*a* is diametrically opposed to the center of concave part 14*c* of cam 14, and the respective radii at those points are 1.0" and 0.5", the sum of which is 1.5".

Basket 16 has a retainer 26 integrally formed in a reinforced bottom portion thereof. The retainer cooperates with a plurality of keys or keepers 28 to secure the basket to the valve stem. The retainer has a downwardly tapered hole and the keepers are likewise downwardly tapered such that the retainer and associated keepers together form a valve stem lock. The keepers are shaped so as to extend into the groove of the valve stem and are held therein by wedging action of the cooperatively tapered portion of the retainer. The retainer may alternatively be formed as a separate part fitted into a hole in the basket. Examples of retainer/keeper sets are disclosed in U.S. Pat. Nos. 4,327,677 and 4,922,867, which are incorporated herein by reference.

In an alternative embodiment suited for valves in which the groove is closer to the tip of the stem than in the first embodiment, the retainer is formed in the top of a hollow conical member extending up from the bottom of the basket enough to enclose the groove. The system may also provide an extension of the valve guide as additional lateral support for the stem in retrofit applications involving removal of a return spring. In cases with replaceable valve guides, a longer valve guide may be installed which extends into the space formerly occupied by the return spring. In other cases, e.g., heads with cast guides, the guide may be drilled and tapped to receive a threaded cylindrical extension, preferably with an oil seal and/or a roller guide on top.

The basket also includes a reinforced upper portion or flange 16*a* adjacent each axial end for a cam follower 18, the flange and cam follower having complementary shapes for retaining the cam follower as shown in FIGS. 2 and 3. A hole 17 is provided in the top of the basket for insertion of the cam followers, which may each comprise a roller. However, the internal profile of the basket is substantially the same around all of the cams.

The basket preferably has a unitary, or monocoque, construction, with solid side walls and open ends, and is semi-rigid, i.e., slightly flexible but sufficiently rigid that it experiences less than 1% elongation in response to forces applied to it during a cycle of operation of the valve to which it is connected—including in particular the forces applied in the process of returning the valve to its closed position—at camshaft speeds from zero to 5,000 RPM. For example, a basket with a nominal height of 2.5" experiences elongation of less than 0.025" as it pulls the valve stem to close the valve at camshaft speeds up to 5,000 RPM. Basket elongation is the primary contributor to the dynamic lash of the valve, which is understood to be the variable lash occurring in operation, i.e., the clearance between the valve stem and cam 12 during operation. Basket elongation of up to 0.100" may be suitable with certain engine designs, but the basket is preferably sufficiently rigid that it limits the dynamic lash to 0.020-0.030", more preferably less than 0.010" and, most preferably, 0.005" or less. One suitable material is thin-wall cast titanium because of its superior fatigue life which offers the possibility of a basket lifetime in the range of nearly half a billion cycles to a billion cycles of operation, which roughly corresponds to 100,000-250,000 miles of vehicle use. The basket preferably has variable wall thickness, with greater thickness in its top and bottom walls than in its side walls, and a gradual change in between. The side walls are generally thinner than the top and bottom of the basket, the difference in thickness being due in part to the above-described reinforced upper portion or flange 16*a* and the reinforced bottom portion for retainer 26. Alternatively, but preferably in addition, the entire upper portion of the basket down to, or beyond, the midpoint of the upper curved portion may have a greater wall thickness than the straight side wall portion. As another alternative, but preferably in addition, the entire lower portion of the basket up to, or beyond, the midpoint of the lower curved portion may have a greater wall thickness than the straight side wall portion. A nitrate coating, e.g., titanium nitrate, or other anti-wear coating may be provided on the inside wall surfaces of the basket to resist wear due to contact with the closing cam. There is preferably a gap between the bottom portion of the basket and shoulder 14*b* when the valve is closed (FIG. 2) and, likewise, a gap between the top portion of the basket and shoulder 14*b* when the valve is open (FIGS. 3 and 4). The basket is preferably dimensioned to provide a gap of at least 0.001" at substantially all points between it and cam 14 at rest, throughout the operating temperature range of the engine.

The basket in its free, unassembled state has sufficient flexibility to elongate more than 1%, which is advantageous for providing preload as will be described. It retains this capability after assembly and preload, when at rest with the gap of at least 0.001". However, its elongation in response to forces applied to it during a cycle of operation is limited to less than 1% as mentioned above because it narrows as it elongates in response to tension, enough so that its side walls close this resting gap and come into contact with cam 14, which prevents further narrowing at the point(s) of contact and thus greatly limits further elongation, as will be described. While less preferred, the basket may be sufficiently rigid that, even without contact with cam 14, it experiences less than 1% elongation in response to forces applied to it during the valve cycle.

The assembly process begins by mounting the baskets on the camshaft before the camshaft is installed in the head. The baskets are moved axially over the cams on the camshaft to their respective cams 12 and 14. When all the baskets are so mounted, the camshaft is placed in the bearing blocks in the head and secured. Each valve is then installed by sliding its stem through a valve guide and through the hole in the bottom of an associated basket. With the cams oriented as shown in FIG. 2, the stem is advanced and the basket is lowered as necessary for the groove in the stem to pass beyond the retainer in the basket, and the keepers are then inserted through one or both open ends of the basket and placed in the groove, after which the retainer in the basket is moved into place surrounding the keepers, thereby holding them in the groove. Each cam follower 18 is then inserted through the hole 17 in the top of the basket and slid into a flange 16*a*, where it is preferably secured in place with a fastener, e.g., screw 19, extending into the flange through the top of the basket. Screws 19 are preferably aircraft bolts with anti-rotation features, e.g., drilled heads having a common safety wire through them. The top of the cam follower may be tapered in the direction away from hole 17 (toward the axial end of the basket) to provide a wedge shape to facilitate insertion into the flange. The flange and cam follower have complementary shapes for retaining the cam follower, as indicated above, and the wedge shape of the cam follower cooperates with a ramp shape on and in the flange to make the cam follower move down (in the direction toward the camshaft axis) while sliding into the flange longitudinally in the direction away from hole 17 and toward the axial end of the basket. For example, the underside of the flange, and the slot in the flange for receiving the top part of the cam follower, may be angled downwardly away from hole 17, and the mating portions of the top part of the cam follower may be correspondingly angled downwardly away from hole 17. The resulting downward movement of the cam follower as it is inserted causes it to be pressed between cam 14 and the top of the basket and thereby exert an upward force on the latter. The bottom of the basket is restrained by the valve stem via the retainer and keepers, so it is held in place at this time because the valve is closed. Thus, insertion of cam follower 18 preloads the valve stem seating the keepers and tensions, i.e., slightly stretches or elongates, the basket. Cam follower 18 is suitably dimensioned to perform this function.

Those skilled in the art will understand from the foregoing that the basket, or band, is a dual-purpose device: a unitary cam follower and valve preload spring. Its main function is to facilitate desmodromic valve action by positively driving the valve to its closed position during the valve-closing portion of the valve cycle. It also functions as a valve preload spring, in the form of a shaped extension spring. The basket embodiment of FIGS. 1-4 is generally tubular with an oblong transverse cross-section having a major axis and minor axis, and it is mounted on the camshaft with its major axis aligned with the valve stem axis. It is put in tension and thus made to elongate during assembly, along its major axis, so as to preload the valve stem. It also elongates during operation, along its major axis, in response to upward force from the closing cam. An oblong band is also contemplated. In either case, the elongation of the basket, or band, occurs without substantially changing its shape, i.e., its oblong cross-sectional shape is maintained.

Its force per unit length of elongation, i.e., its spring rate, also referred to herein as its effective spring rate, varies depending on conditions. In particular, it has a natural static spring rate in its free state prior to assembly, and when installed but at rest, and it has a much higher effective spring rate in operation when its side walls contact the closing cam, cam portion 14*a*. The basket is sized to closely surround the closing cam, leaving a small gap, e.g., 0.001-0.002", between each side wall and the closing cam after preload. A gap of 0.003-0.005", or larger, may be suitable in certain applications. In operation, the small gap is closed by narrowing of the basket in response to upward force from the closing cam. More specifically, upward force from the cam puts the basket in tension, which causes it to elongate and narrow. The basket is laterally constrained by the cam once the gap is closed, in that side wall contact inhibits the basket's ability to narrow in response to tension. As a result, much more force is required to achieve further elongation. Thus, the effective spring rate is much higher, e.g., ten to twenty times as high.

A 50-pound preload is contemplated as one suitable example, and other preload amounts in the range of 50-100 pounds are also contemplated. Preloads of less than 50 pounds and more than 100 pounds may also be useful in certain applications. The basket may have a static spring rate on the order of 400-800 pounds per inch along its major axis. Other static spring rates in the range of 200-2000 pounds per inch or more are also contemplated, and lower static spring rates, e.g., 50-200 pounds per inch, may be useful in some applications, as may spring rates in the range of 800-1000 or even 1000-2000 pounds per inch. As one example, a 50-pound preload can be provided with a basket having a spring rate of 800 pounds per inch using a cam follower 18 having a height of 1/16" more than the vertical space available for it between closing cam 14*a* and the inside surface of the top of the basket (with the valve keys seated but not tensioned). Insertion of cam follower 18 causes a 1/16" elongation of the basket beyond its nominal height and induces a 50-pound preload on the valve stem:

$$1/16'' \times 800 \text{ lb/in} = 50 \text{ lb}$$

As another example, a 50-pound preload can also be achieved with a 400 lb/inch spring rate and 1/8" elongation due to cam follower 18. 1/16" to 1/8" is the presently preferred range of preload elongation, or change in height, Δh, of the basket or band. More generally, preload forces in the range of 50-100 pounds can be achieved with a spring rate in the 400-800 lb/in range if the cam follower is sized so as to provide a Δh of 1/16" to 1/4".

In operation, starting from the valve-closed position shown in FIGS. 1 and 2, the camshaft rotates nearly 135° to a point at which cam lobe 12*a* begins to engage the valve stem and cam follower 18 simultaneously begins to engage a smaller-radius portion of cam portion 14*a*. Cam lobe 12*a* then exerts a downward force on the valve stem until the camshaft has rotated 180°, to the valve-open position shown in FIG. 3. The valve stem is free to move down because cam follower 18 engages the smaller-radius portion of cam portion 14*a*, including concave part 14*c*, during this part of the cycle, and the valve stem pulls the basket down with it as shown in FIG. 3. Further camshaft rotation causes cam lobe 12*a* to rotate away from the valve stem and correspondingly brings cam follower 18 into contact with points of progressively larger radius on cam portion 14*a*. Cam portion 14*a* thereupon exerts an upward force on cam follower 18 which lifts the basket, which in turn pulls the valve stem up. When the camshaft has rotated a little more than 45° from the position shown in FIG. 3, cam follower 18 again bears against the maximum-radius portion of cam portion 14*a* and the valve is closed. The valve and basket positions at this point are as shown in FIGS. 1 and 2 and remain so for the remainder of the cycle. It will be understood that the above-mentioned angles of 135° and 45° are mere examples and that the angles at which cam lobe 12*a* engages and disengages from the valve stem are functions of desired cam action for a desired valve application.

The circular peripheral portions 14*b* of cam 14 are provided to further resist flexing of the basket and thereby limit its maximum elongation as the valve closes, at which time the concave part 14*c* of cam 14 moves toward one side of the basket and opens up a significant lateral gap. By virtue of their fixed 1" radius, portions 14*b* maintain a minimum of 2" spacing between the opposed sides of the basket at least where they make contact with it. Portions 14*b* (shoulders) may be on either or both sides of each side cam 14 on the camshaft axis, i.e., the side closer to the central cam, the opposite side, or both. The side closer to the central cam is closer to the line of force (tension) between stem 22 and cam follower 18 during valve closure. Alternatively, a constant-radius disc such as portion 14*b* may be provided on either or both sides of central cam 12, and such a disc may help with camshaft balancing. Except when the basket is in tension due to the upward force from the closing cam during the valve-closing portion of the valve cycle, the spacing between the shoulder and the basket side wall should be not less than 0.001" throughout the operating temperature range of the engine.

As those skilled in the art will appreciate from the above, each shoulder 14*b* is an auxiliary physical constraint, an internal constraint within the basket which augments the internal lateral constraint provided by cam 14*a* itself. It will also be appreciated that the cylinder head conventionally has open space on opposite sides of the camshaft adjacent each cam, as noted above, so there is no external lateral constraint on the side walls of the basket. That is, the basket has externally, laterally unconstrained side walls. It is constrained to motion along the valve stem axis without an external guide on either side thereof. The auxiliary internal constraint—the shoulder—is a constant-radius disc of radius equal to the maximum side cam radius, and it is disposed parallel to side cam 14*a* and substantially surrounded circumferentially by the basket. The system preferably has multiple side cams as in the first embodiment but may have a single side cam per valve. The shoulder cooperates with side cam 14*a* and further inhibits the basket's ability to narrow in response to tension. The shoulder also helps constrain the basket to motion along the valve stem axis by, for example, resisting rocking of the basket as could otherwise occur as the concave part or notch

14*c* of cam 14 cycles from one side of the basket to the other. With reference to FIG. 3, the notch is shown in the 12:00 position and side cam 14*a* spans the distance between the basket's side walls. However, when the notch is in the 3:00 or 9:00 position, there is a significant lateral gap between side cam 14*a* and one side wall because of the concavo-convex shape of side cam 14*a*. The size of the lateral gap at that point in the cycle can be appreciated from FIG. 3 by observing the vertical space between the uppermost points on cam 14*a* and the uppermost point on the 1"-radius shoulder, approximately ¼" in this embodiment. The constant-radius shoulder leaves no such gap and thereby inhibits narrowing of the basket which could otherwise occur. This contributes to the substantial increase in the basket's effective spring rate in operation.

As an alternative, or in addition, an external basket guide may be useful in certain applications. In one implementation of such a guide, a stationary pin is suspended above the basket on the valve stem axis such that it extends through hole 17 in the top of the basket, the pin having sufficient length to extend through hole 17 throughout the valve cycle, i.e., when the valve is closed (FIGS. 1 and 2) and, by a small amount, when the valve is open (FIGS. 3 and 4). The pin may have a diameter slightly less than the inside diameter of hole 17, whereby it provides direct lateral support for the top of the basket. Alternatively, a somewhat smaller-diameter pin may slidably engage a steel collet having external threads by which it is screwed into hole 17. In the latter case, as the collet reciprocates during operation, the pin slides within it and thereby provides indirect lateral support for the top of the basket. In either case, such a guide pin may be suspended from a horizontal support bar disposed above and parallel to the camshaft axis and bolted or otherwise secured to adjacent bearing blocks.

In an alternative embodiment, the desmodromic valve system has a parallel pair of rings or bands instead of the basket described above. The bands are preferably joined at the bottom by a bridge which includes a retainer such as described above, in a unitary construction or as separate parts. A single band with a single cam 14 is also contemplated.

The basket with cam follower(s) 18 is effectively a clamp. In cooperation with cam(s) 14, it clamps the central cam (cam 12) to the valve stem, whereby the valve stem is virtually an ideal cam follower throughout the valve cycle. It is strongly preferred to have the clamp extend completely around the central cam circumferentially as shown in the drawings and described above. However, in some applications, it may be adequate for the clamp to extend around the cam on only one side of the camshaft, i.e., the left or right side as viewed in FIG. 2, akin to a C-clamp, with curved or straight vertical and horizontal segments. The clamp may comprise one half of the basket described above, i.e., the left or right half as viewed in FIG. 2, but including the full retainer and keys and the cam followers as described above. The cam followers may be fixed in position in supporting flanges as described above, or may be vertically adjustable by means of a threaded connection to the top of the clamp or otherwise. Alternatively, the cam followers may be integral parts of the clamp. Such a clamp is provided, if necessary, with suitable means to keep it aligned with the valve stem. For example, a horizontal support bar or guard rail may be provided on the head so as to abut the back side of the half basket (the side opposite the cam) at the level of the camshaft axis. The support bar may, for example, be bolted or otherwise secured to adjacent bearing blocks.

As an alternative to the half basket just described, a clamp in the form of a half ring akin to a C-clamp may be adequate in some applications. This clamp may have approximately the same width along the camshaft axis as cam 14, and be aligned with that cam, but have an axial projection rigidly connecting it to the valve stem. It may have the same general cross-sectional shape as the left or right half of the basket as viewed in FIG. 2. If necessary, a horizontal support bar or guard rail, as described above, is provided which includes a vertical guide, such as a slot to receive the back of the clamp, to keep the clamp vertically aligned.

Cams 12 and 14 have complementary shapes as described above, and they are preferably complementary around their entire circumferences, but may be partially complementary in certain applications. It is particularly advantageous for cam 14 to complement cam 12 for the valve-closing portion of the valve cycle, so as to generate a lifting force via the basket or other clamp as soon as the maximum-radius portion of cam lobe 12*a* is past the valve stem. However, an upward force is not necessarily required from the basket during every part of the valve cycle, e.g., during the compression stroke and power stroke of a four-stroke engine, and so, in some applications, the side cam may have a relatively small radius for a significant part of its circumference corresponding to such parts of the cycle (and thus have less rotating mass), provided that the basket is suitably secured to the valve stem and kept aligned with it. The basket may be secured by means of a cap screwed over the keys to keep them in place, or, for some applications, a threaded connection without keys may be adequate. A horizontal support bar or guard rail as described above may be provided on each side of the basket for alignment purposes if necessary.

One example of such a side cam is cam 14*a*' in FIG. 3A. Cam 14*a*' is designed for clockwise rotation. It extends approximately 120° around the camshaft as illustrated, and it has the same radius as cam 14*a* of the first embodiment for approximately 90°, in the circumferential range from point A to point B, which includes the valve-closing portion of the valve cycle. Those skilled in the art will appreciate that cam 14*a*' and cam 12 are complementary for that part of the valve cycle. This embodiment preferably includes a circular portion 14*b* joined to cam 14*a*' and having a constant 1" radius as in the first embodiment. A counterweight 30 is optionally provided on the opposite side of the camshaft from cam 14*a*' for balancing purposes, and may be mounted on portion 14*b* as shown. Camshaft balance can also be achieved by removing weight, e.g., by machining away areas of portion 14*b* adjacent to cam 14*a*', and/or by initially forming such adjacent areas and cam 14*a*' itself with apertures therein, such as in a spoked wheel. Camshaft balance can be achieved by adding or deleting material or a combination of the two.

Depending on the rigidity of the basket, portion 14*b* may be made with a greater axial width (along the camshaft axis) than portion 14*b* in the first embodiment, for purposes of structural integrity. Alternatively, a cam 14 may have a part 14*a*' (as in FIG. 3A) with the axial width of original part 14*a* (see FIG. 1), and also include the remainder of original part 14*a* but with half its width, whereby some part of cam 14 engages cam follower 18 throughout the cycle, thus maintaining the preload on the valve stem and reinforcing portion 14*b*.

Another embodiment 110 of the invention is depicted in FIGS. 7-10, wherein like numerals represent like parts throughout the several views. This embodiment and variations thereof may be the same as the embodiment of FIGS. 1-5 and its variations as discussed above, with exceptions as discussed below. A central cam 112 and a parallel pair of side cams 114 are fixedly mounted on a camshaft 115 so as to rotate therewith, and are substantially surrounded by a semi-rigid band or "basket" 116 which does not rotate with the camshaft and is constrained by the cams and by its attachment to the stem of a valve 122.

The primary difference with this embodiment is that the basket and cams are designed for a ¼ inch valve lift. Basket 116 engages paired side cams 114 and the associated valve stem so as to pull the valve stem after it is pushed by central cam 112. The basket and cams cooperate to provide reciprocating valve action with positive bidirectional drive. That is, the system positively drives the valve from its closed position, illustrated in FIGS. 7 and 8, to its open position, illustrated in FIGS. 9 and 10, by conventional cam action by means of cam 112 in contact with the valve stem, and positively drives the valve back to its closed position using the basket, which is secured to the valve stem and raised by paired cams 114 acting through associated cam followers 118.

Each cam 114 has a main portion with a concavo-convex cross-section, and a peripheral portion or shoulder with a circular cross-section. In FIGS. 7 and 8, the concave part of cam 114 is below the camshaft axis (and axially separated from the valve stem), and the convex portion engages the associated cam follower 118 and thereby holds the basket in its raised position. Cams 112 and 114 operate in coordinated fashion such that, at this point in the cycle, the lobe of cam 112 is oriented away from the valve stem and thereby allows the valve to be lifted and thus closed by the basket. Conversely, in FIGS. 9 and 10, the concave part of cam 114 is above the camshaft axis and the lobe of cam 112 is oriented toward the valve stem, whereby cam follower 118—and thus basket 116—is in its lowest position and the valve is open.

While the basket and cams are all shown as smaller in this embodiment than in the first embodiment, the basket may have the same size and shape in both embodiments, and a shoulder such as shoulder 14*b* may optionally be included and may have the same size and shape in both embodiments. Thus, the same basket may be used in different engines having different valve lifts, or in the same engine in situations where it is desired to change the valve lift, e.g., to increase performance. In the case of using the basket of the first embodiment with cams the size of cams 112 and 114 in the second embodiment, a corresponding change is made to the cam follower height, the cam mounting height, and/or the valve stem. For example, the height of the associated cam followers 118 may accordingly be increased to a height ¼' greater than that of cam follower 18 in the first embodiment. This change is sufficient if the central cam has the same base circle and the same valve stem is used as in the first embodiment, such that the valve stem groove is the same distance from the base circle. As one alternative, cam followers of the same height as cam follower(s) 18 may be used with a valve having a groove in a lower position on the stem than in the first embodiment.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

I claim:

1. A unitary cam follower and valve preload spring for a desmodromic valve mechanism having opening and closing cams mounted in parallel on an overhead camshaft so as to facilitate positive bidirectional drive of a valve, comprising:

a one-piece, generally tubular spring member of oblong transverse cross-section having a major axis and minor axis, configured to be nonrotatably mounted on the camshaft with its longitudinal axis parallel to the camshaft axis and its major axis aligned with the valve stem axis, substantially surrounding the opening and closing cams circumferentially and engaging the valve stem and closing cam so as to pull the valve stem in response to an upward force applied to the upper portion of said spring member by the closing cam, said spring member further configured to elongate along its major axis in response to tension applied thereto while engaging it with the valve stem and closing cam during assembly so as to preload the valve stem.

2. The unitary cam follower and valve preload spring of claim 1, wherein said spring member is sized with respect to the closing cam such that it elongates less than 1% in response to closing cam force during operation at camshaft speeds from zero to 5,000 RPM.

3. The unitary cam follower and valve preload spring of claim 1, wherein said spring member is sized with respect to the closing cam such that the closing cam laterally constrains it during operation.

4. The unitary cam follower and valve preload spring of claim 3, wherein said generally tubular spring member has an inner diameter on its minor axis approximately equal to the maximum diameter of the closing cam, whereby the elongation of said spring member is limited by side wall contact with the closing cam.

5. The unitary cam follower and valve preload spring of claim 1, wherein said generally tubular spring member has opposed side wall portions extending substantially parallel to its major axis for a distance greater than or equal to the valve lift.

6. The unitary cam follower and valve preload spring of claim 1, wherein said spring member is configured to engage the closing cam via an auxiliary cam follower internally attached to the upper portion of said spring member and extending downwardly therefrom, whereby upward force from the closing cam is applied to the upper portion of said spring member through the auxiliary cam follower.

7. The unitary cam follower and valve preload spring of claim 1, wherein said spring member is made of material enabling it to respond to closing cam force without substantial change in shape.

8. The unitary cam follower and valve preload spring of claim 7, wherein said spring member is made of thin-wall cast titanium and has a reinforced upper portion and a reinforced bottom portion.

9. A unitary cam follower and valve preload spring for a desmodromic valve mechanism having opening and closing cams mounted in parallel on an overhead camshaft so as to facilitate positive bidirectional drive of a valve, comprising:

a generally tubular spring member of oblong transverse cross-section having a major axis and minor axis, configured to be nonrotatably mounted on the camshaft with its major axis aligned with the valve stem axis, substantially surrounding the opening and closing cams circumferentially, said generally tubular spring member having a minor axis inner diameter approximately equal to the maximum diameter of the closing cam, and a major axis inner diameter at least approximately 25% greater than its minor axis inner diameter.

10. The unitary cam follower and valve preload spring of claim 9, wherein said spring member is configured to engage the valve stem and closing cam and, when so engaged during assembly, to elongate along its major axis in response to tension applied thereto so as to preload the valve stem.

11. The unitary cam follower and valve preload spring of claim 9, wherein said spring member is configured to engage the valve stem and closing cam so as to pull the valve stem in response to an upward force applied to the upper portion of said spring member by the closing cam, said spring member being sufficiently flexible that, while engaged with the closing cam, it elongates along its major axis with a peak increase of 0.005-0.030" in response to closing cam force at high engine speeds.

12. The unitary cam follower and valve preload spring of claim 11, wherein said spring member is made of material enabling it to respond to closing cam force without substantial change in shape.

13. The unitary cam follower and valve preload spring of claim 9, wherein said spring member is made of thin-wall cast titanium and has a reinforced upper portion and a reinforced bottom portion.

14. The unitary cam follower and valve preload spring of claim 11, wherein said spring member is configured to engage the closing cam via an auxiliary cam follower internally attached to the upper portion of said spring member and extending downwardly therefrom, whereby upward force from the closing cam is applied to the upper portion of said spring member through the auxiliary cam follower.

15. A cam follower and valve preload spring having opening and closing cams mounted in parallel on an overhead camshaft so as to facilitate positive bidirectional drive of a valve, comprising:

an oblong band configured to extend circumferentially around the closing cam and engage it and the valve stem so as to reciprocate and cyclically lift the valve stem in response to rotation of the closing cam, with the major axis of said oblong band approximately aligned with the valve stem axis, said oblong band configured to elongate along its major axis in response to tension applied thereto while engaging it with the valve stem and closing cam during assembly so as to preload the valve stem.

16. The unitary cam follower and valve preload spring of claim 15, wherein said oblong band is further configured to elongate along its major axis as it lifts the valve stem during operation, with flexibility sufficient to provide maximum elongation in the range of 0.005-0.030" in response to closing cam force at high engine speeds.

17. The unitary cam follower and valve preload spring of claim 16, wherein said oblong band has an inner diameter on its minor axis approximately equal to the maximum diameter of the closing cam, whereby the elongation of said oblong band is limited by side wall contact with the closing cam.

18. The unitary cam follower and valve preload spring of claim 16, wherein said oblong band is made of material enabling it to respond to closing cam force without substantial change in shape.

19. The unitary cam follower and valve preload spring of claim 15, wherein said oblong band is made of thin-wall cast titanium and has a reinforced upper portion and a reinforced bottom portion.

20. The unitary cam follower and valve preload spring of claim 15, wherein said oblong band is configured to extend completely around the closing cam circumferentially.

21. The unitary cam follower and valve preload spring of claim 20, wherein said oblong band has a width along the camshaft axis sufficient to substantially surround the opening and closing cams circumferentially.

22. The unitary cam follower and valve preload spring of claim 21, wherein said oblong band has a one-piece construction with solid side walls and open ends.

* * * * *